US008199056B2

(12) United States Patent
Pohjonen

(10) Patent No.: US 8,199,056 B2
(45) Date of Patent: Jun. 12, 2012

(54) ANTENNA ARRANGEMENT

(75) Inventor: Helena Pohjonen, Espoo (FI)

(73) Assignee: Nokia Corporation, Espoo (FI)

( * ) Notice: Subject to any disclaimer, the term of this patent is extended or adjusted under 35 U.S.C. 154(b) by 659 days.

(21) Appl. No.: 11/992,792

(22) PCT Filed: Oct. 13, 2005

(86) PCT No.: PCT/IB2005/003180

§ 371 (c)(1),
(2), (4) Date: Jun. 23, 2009

(87) PCT Pub. No.: WO2007/042856

PCT Pub. Date: Apr. 19, 2007

(65) Prior Publication Data

US 2009/0309795 A1 Dec. 17, 2009

(51) Int. Cl.
*H01Q 1/38* (2006.01)

(52) U.S. Cl. ..... 343/700 MS; 343/722

(58) Field of Classification Search ..... 343/700 MS, 343/722, 846, 850, 893
See application file for complete search history.

(56) References Cited

U.S. PATENT DOCUMENTS

| | | | | |
|---|---|---|---|---|
| 3,806,928 | A * | 4/1974 | Costanza | 342/4 |
| 5,448,209 | A | 9/1995 | Hirai et al. | 333/204 |
| 5,627,541 | A * | 5/1997 | Haley et al. | 342/1 |
| 5,773,917 | A | 6/1998 | Satoh et al. | 310/364 |
| 6,515,558 | B1 | 2/2003 | Ylilammi | 333/189 |
| 7,132,984 | B2 * | 11/2006 | Kameda et al. | 343/700 MS |

FOREIGN PATENT DOCUMENTS

| | | |
|---|---|---|
| EP | 1 378 959 | 1/2004 |
| EP | 1 475 744 | 11/2004 |
| EP | 1 548 872 | 6/2005 |
| JP | 2004 129016 | 4/2004 |
| WO | WO 00/11747 | 3/2000 |

OTHER PUBLICATIONS

Dubois, M-A., "Thin Film Bulk Acoustic Wave Resonators: a Technology Overview", MEMSWAVE 03, Toulouse, France, Jul. 2-4, 2003, 4 pgs.

Kim, B.C., et al., "Design of a Compact PIFA for Mobile Phones", Radio & Broadcasting Technology Laboratory, pp. 809-812.

* cited by examiner

*Primary Examiner* — Hoang V Nguyen
(74) *Attorney, Agent, or Firm* — Harrington & Smith

(57) ABSTRACT

An antenna arrangement including a first antenna element having one or more surfaces; and a laminate attenuator, positioned adjacent a portion of at least one surface of the first antenna element, wherein the laminate attenuator is arranged or attenuating predetermined radio frequency electromagnetic waves.

20 Claims, 5 Drawing Sheets

ANTENNA ARRANGEMENT

FIELD OF THE INVENTION

Embodiments of the present invention relate to antenna arrangements. In particular, they relate to antenna arrangements in portable cellular telephones.

BACKGROUND TO THE INVENTION

Electronic communication devices such as portable cellular telephones usually comprise an antenna arrangement to transmit and receive electromagnetic waves. In recent years, the number of antenna elements within antenna arrangements has increased to enable communication devices to communicate over a greater number of radio frequency bands.

An antenna arrangement may include at least one antenna element mounted on a ground plane (typically the printed wiring board of the communication device). Due to electromagnetic coupling between the antenna element and the ground plane, the height of the antenna element above the ground plane affects the bandwidth of the antenna element. Specifically, the bandwidth of the antenna element decreases as the height of the antenna element above the ground plane decreases. Consequently, the height of the antenna element above the ground plane must usually be greater than a minimum threshold height to ensure reasonable bandwidth. For example, in a mobile telephone an internal antenna such as a PIFA or loop antenna will usually have a minimum threshold height which is usually greater than 4 mm dependent upon the bandwidth to be covered. Consequently, electromagnetic coupling between an antenna element and a ground plane is one factor which determines the volume of space required for an antenna arrangement within an electronic communication device.

If there is more than one antenna element mounted on the ground plane, electromagnetic coupling may occur between the antenna elements. This electromagnetic coupling may affect the impedance (and hence the resonant frequency) of the antenna elements. This problem may be particularly acute in communication devices which include one or more moveable antenna elements. One current solution to this problem is to physically separate the antenna elements as much as possible. However, one disadvantage associated with this solution is that it may increase the size of the antenna arrangement. Another solution to this problem is to provide additional electronic circuitry to minimise the effects of electromagnetic coupling. One example of additional electronic circuitry is an isolator which may be used to minimise the effects of antenna impedance changes presented to the connected communications circuitry. An isolator is usually positioned between the power amplifier and the antenna element to prevent unwanted signals from affecting the transmitter output. However, one disadvantage associated with additional electronic circuitry is that it may increase losses which result in increased power consumption. Another disadvantage associated with additional electronic circuitry is that it may increase the cost of the electronic communication device.

Consequently, it is desirable to provide an alternative antenna arrangement.

BRIEF DESCRIPTION OF THE INVENTION

According to one embodiment of the invention there is provided an antenna arrangement comprising: a first antenna element having one or more surfaces; and a laminate attenuator, positioned adjacent a portion of at least one surface of the first antenna element, wherein the laminate attenuator is arranged for attenuating predetermined radio frequency electromagnetic waves.

The antenna arrangement may further comprise a ground plane, wherein the laminate attenuator may be positioned between the first antenna element and the ground plane.

The first antenna element may be operable in at least a first operational frequency band and the laminate attenuator may be arranged to attenuate electromagnetic waves having a frequency within the first operational frequency band.

The laminate attenuator may comprise a plurality of laminas, wherein at least one of the laminas may comprise metal.

The laminate attenuator may comprise a transducer which is arranged to convert electromagnetic waves having a frequency within the first operational frequency band into an acoustic wave having a frequency within the first operational frequency band.

The laminate attenuator may comprise a plurality of laminas. The transducer may be positioned between the first antenna element and the plurality of laminas.

The laminate attenuator may comprise a first material and a second material which are arranged alternately to form the plurality of laminas. The first material and the second material may have substantially different acoustic impedances.

Each lamina of the plurality of laminas may have a thickness which is equal to one quarter of the wavelength of the acoustic wave.

At least one of the plurality of laminas may comprise metal.

The transducer may comprise piezoelectric material.

The antenna arrangement may further comprise a second antenna element, operable in at least a second operational frequency band. The laminate attenuator may be arranged to attenuate an electromagnetic wave having a frequency within the second operational frequency band.

The laminate attenuator may comprise a transducer which is arranged to convert electromagnetic waves having a frequency within the second operational frequency band into an acoustic wave having a frequency within the second operational frequency band.

The laminate attenuator may comprise a plurality of laminas which are positioned adjacent the first antenna element. The transducer may be positioned adjacent the plurality of laminas, remote from the first antenna element.

The laminate attenuator may comprise a first material and a second material which are arranged alternately to form the plurality of laminas. The first material and the second material may have substantially different acoustic impedances.

Each lamina of the plurality of laminas may have a thickness which is equal to one quarter of the wavelength of the acoustic wave.

The transducer may comprise piezoelectric material

The laminate attenuator may be positioned adjacent each surface of the first antenna element.

The first antenna element may be operable in at least a first operational frequency band. The antenna arrangement may comprise a further laminate attenuator, positioned adjacent a portion of at least one surface of the first antenna element. The further laminate attenuator may be arranged to attenuate electromagnetic waves having a frequency within the first operational frequency band.

The antenna arrangement may further comprise a ground plane. The further laminate attenuator may be positioned between the first antenna element and the ground plane.

According to a second embodiment of the invention there is provided an electronic device comprising an antenna arrangement as described in the preceding paragraphs.

According to a third embodiment of the invention there is provided a method of forming an antenna arrangement, comprising: providing a first antenna element having one or more surfaces; positioning a laminate attenuator adjacent a portion of at least one surface of the first antenna element, wherein the laminate attenuator is arranged to attenuate predetermined radio frequency electromagnetic waves.

According to a fourth embodiment of the invention there is provided a use of a laminate attenuator in an antenna arrangement, the laminate attenuator comprising: a first material and a second material, arranged alternately to form a plurality of laminas, the first material and the second material having substantially different acoustic impedances.

BRIEF DESCRIPTION OF THE DRAWINGS

For a better understanding of the present invention reference will now be made by way of example only to the accompanying drawings in which.

DETAILED DESCRIPTION OF EMBODIMENTS OF THE INVENTION

Figure 1:
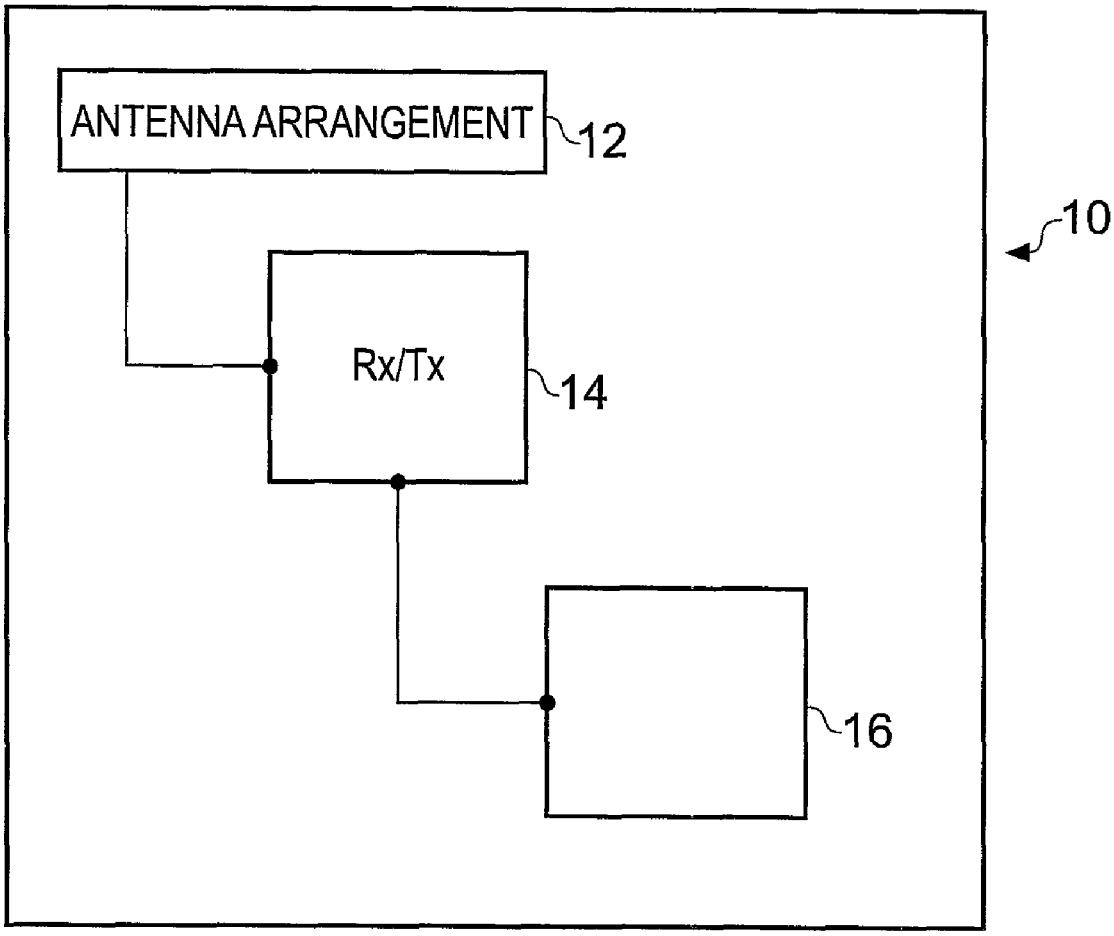
FIG. 1 illustrates a schematic diagram of a radio transceiver device comprising an antenna arrangement.

The figures illustrate an antenna arrangement 12 comprising: a first antenna element 18 having one or more surfaces 24; and a laminate attenuator 26, positioned adjacent a portion of at least one surface 24 of the first antenna element 18, wherein the laminate attenuator 26 is arranged for attenuating predetermined radio frequency electromagnetic waves.

In more detail, FIG. 1 illustrates a schematic diagram of a radio transceiver device 10 such as a mobile cellular telephone, cellular base station, other radio communication device or module for such devices. The radio transceiver device 10 comprises an antenna arrangement 12, radio transceiver circuitry 14 connected to the antenna arrangement 12 and functional circuitry 16 connected to the radio transceiver circuitry 14. In the embodiment where the radio transceiver device 10 is a mobile cellular telephone, the functional circuitry 16 includes a processor, a memory and input/output devices such as a microphone, a loudspeaker and a display. Typically the electronic components that provide the radio transceiver circuitry 14 and functional circuitry 16 are interconnected via a printed wiring board (PWB). The PWB may be used as a ground plane for the antenna arrangement 12.

Figure 2:
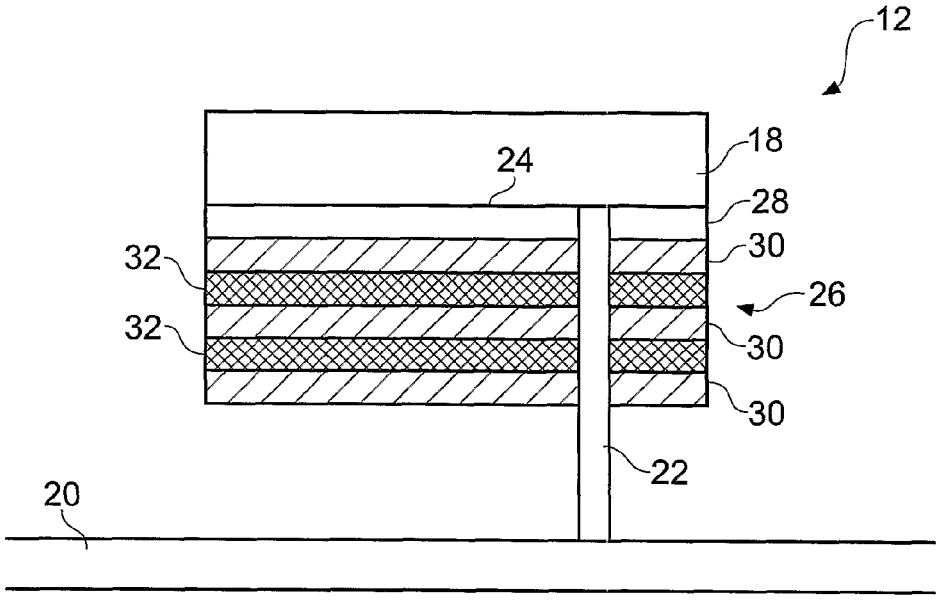
FIG. 2 illustrates a schematic side view of an antenna arrangement according to a first embodiment of the invention.

With reference to FIG. 2, in a first embodiment of the invention the antenna arrangement 12 includes an antenna element 18 coupled to a ground plane 20 via a feed 22. A laminate attenuator 26 is located between the antenna element 18 and the ground plane 20 to reduce electromagnetic coupling between the antenna element 18 and the ground plane 20. This reduction in electromagnetic coupling may isolate the antenna element 18 from the ground plane 20 and thereby increase the bandwidth of the antenna element 18 when it is at a given height above the ground plane 20.

In more detail, the shape of the antenna element 18 is a bar in this embodiment to simplify the figures and aid understanding of embodiments of the invention. However, the shape of the antenna element 18 may be different and may be, for example, a helix or a patch. The antenna element 18 is arranged to transmit and receive electromagnetic waves having a frequency within a first operational frequency band. The first operational frequency band is a radio frequency band and may be, for example, US-GSM 850 (824-894 MHz), EGSM 900 (880-960 MHz), PCN/DCS1800 (1710-1880 MHz), PCS1900 (1850-1990 MHz), US-WCDMA1900 (1850-1990), WCDMA21000 band (Tx: 1920-1980, Rx: 2110-2180) or WLAN\BLUETOOTH (2400 MHz).

In this embodiment, the feed 22 is coupled to a bottom surface 24 of the antenna element 18. The feed 22 mechanically and electrically couples the antenna element 18 to the ground plane 20. The feed 22 and the laminate attenuator 26 do not physically contact one another and are consequently electrically isolated from one another. It may be necessary to form a via hole in the laminate attenuator 26 for the feed 22. Any suitable process for forming via holes may be used, for example, chemical etching or drilling. In other embodiments, the feed 22 may be connected to a side surface of the antenna element 18.

In one embodiment, the feed 22 includes a single conductor. In another embodiment the feed 22 includes a pair of conductors which provide a feed and an electrical ground.

The laminate attenuator 26 is positioned adjacent the bottom surface 24 of the antenna element 18 and between the antenna element 18 and the ground plane 20. In one embodiment, the laminate attenuator 26 contacts the bottom surface 24 of the antenna element 18. In another embodiment, the laminate attenuator 26 does not contact the bottom surface 24 of the antenna element 18 but is positioned in proximity to the bottom surface 24 of the antenna element 18. Consequently, the use of the word 'adjacent' should be understood to include 'contacting' or 'positioned in proximity to'.

For example, in the embodiment where the laminate attenuator 26 is contacting the bottom surface 24 of the antenna element 18, the laminate attenuator 26 may be formed on the antenna element 18 using any suitable method, such as sputtering or chemical vapour deposition (CVD), so that it is physically attached to the antenna element 18.

In this embodiment, the laminate attenuator 26 includes a transducer 28 which is coupled to the bottom surface 24 of the antenna element 18. The transducer 28 is arranged to convert incident electromagnetic waves having a frequency within the first operational frequency band into acoustic waves having a frequency within the first operational frequency band. The transducer 28 may comprise any suitable piezoelectric material, for example it may comprise AlN (aluminium nitride), ZnO (zinc oxide) or PZT (lead zirconate titanate).

The laminate attenuator 26 also includes a first material 30 and a second material 32 which are arranged alternately to form a plurality of laminas. The plurality of laminas are oriented substantially parallel to the transducer 28 and are physically coupled to the transducer 28. They are 'stacked' towards the ground plane 20. The transducer 28 and each one of the plurality of laminas are contiguous with one another and have substantially the same surface area as the bottom surface 24 of the first antenna 18.

The first material 30 has a substantially different acoustic impedance to the second material 32. In this embodiment, the first material 30 is tungsten (W) which has a high acoustic impedance and the second material 32 is silicon dioxide ($SiO_2$) which has a low acoustic impedance. The ratio of the acoustic impedance of tungsten and the acoustic impedance of silicon dioxide is 8:1. Alternatively, the first material 30 may be aluminium nitride (AlN) and the second material 32 may be silicon dioxide. The ratio of the acoustic impedance of aluminium nitride and the acoustic impedance of silicon dioxide is 3:1.

The thickness of each lamina of the first material 30 and the second material 32 is equal to a quarter wavelength of a predetermined frequency within the first operational frequency band. For example, if the frequency of the incident acoustic waves is 2 GHz, the thickness of each lamina is approximately 1 micrometer. Consequently, it will be appreciated that the thickness of a lamina is dependent upon the material of the lamina (which determines the permittivity and hence refractive index of the lamina) and the predetermined frequency of incident electromagnetic waves. Therefore, a lamina of the first material 30 may have a different thickness to a lamina of the second material 32.

In operation, the antenna element 18 transmits and receives electromagnetic waves having a frequency within the first operational frequency band. Electromagnetic waves transmitted from the bottom surface 24 are received as incident electromagnetic waves by the transducer 28. The transducer 28 converts the incident electromagnetic waves having a frequency within the first operational frequency band into acoustic waves having a frequency within the first operational frequency band. The acoustic waves are then at least partially reflected at each interface between the laminas of the first and second materials 30 and 32. The thickness of each lamina results in destructive interference between incident acoustic waves and reflected acoustic waves thereby resulting in attenuation of the acoustic waves.

Consequently, the laminate attenuator 26 may isolate (electromagnetically) the antenna element 18 from the ground plane 20. This may improve the bandwidth of the antenna element 18 at a given height above the ground plane 20. In at least one embodiment, the antenna element 18 and the ground plane 20 are sufficiently isolated from one another to enable the laminate attenuator 26 to be placed on the ground plane 20. Since the thickness of the laminate attenuator 26 is usually less than 1 mm, this may result in the antenna arrangement 12 having a low profile. Consequently, the use of a laminate attenuator 26 may reduce the volume of space required for the antenna arrangement within the radio transceiver device 10.

Figure 3:
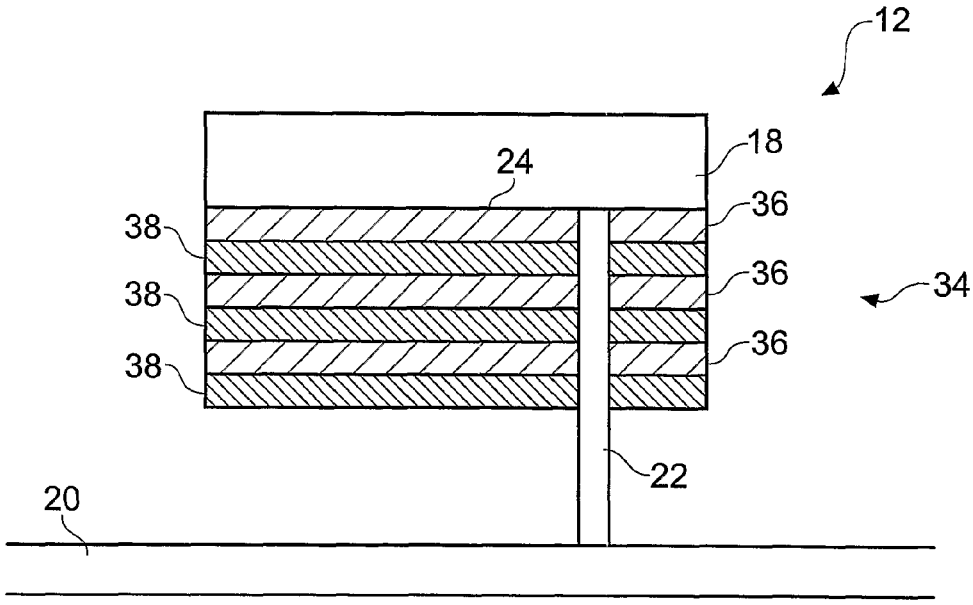
FIG. 3 illustrates a schematic side view of an antenna arrangement according to a second embodiment of the invention.

FIG. 3 illustrates a schematic side view of an antenna arrangement 12 according to a second embodiment of the invention. Where the features illustrated in FIG. 3 are similar to those illustrated in FIG. 2, the same reference numerals have been used. In this embodiment, the laminate attenuator 34 does not include a transducer for converting electromagnetic waves into acoustic waves. Instead, the laminate attenuator 34 comprises at least one metal lamina which acts as a radiation shield, thereby reducing electromagnetic coupling between the antenna element 18 and the ground plane 20.

In more detail, the laminate attenuator 34 includes a first material 36 and a second material 38 which are arranged alternately to form a plurality of contiguously stacked laminas. The thickness of each lamina is approximately 1 micrometer. The first material 36 comprises a dielectric such as silicon dioxide and the second material 38 comprises metal such as tungsten or molybdenum (Mo).

In operation, the antenna element 18 transmits and receives electromagnetic waves. Electromagnetic waves transmitted from the bottom surface 24 are received as incident electromagnetic waves by the laminate attenuator 34. The metal laminas 38 act as RF shields (which work in a similar way to a Faraday cage) for incident electromagnetic waves and thereby isolate (electromagnetically), the antenna element 18 from the ground plane 20. In more detail, an electric field of an incident electromagnetic wave generates a current within a metal lamina 38 that causes displacement of charge therein. This effect at least partially cancels the incident electric field. Similarly, a varying magnetic field of an incident electromagnetic wave generates vortices within a metal lamina 38. This effect at least partially cancels the incident magnetic field. Consequently, the metal laminas 38 act as an attenuator of incident electromagnetic waves.

Additionally, the impedance of the first material 36 (dielectric material) is different to the impedance of the second material 36 & 38 (metal). This results in reflection of incident electromagnetic waves at the interfaces between the laminas of the first and second materials 38. If the thickness of each lamina of the plurality of laminas is one quarter of a wavelength of incident electromagnetic waves, the reflected electromagnetic waves will destructively interfere with incident electromagnetic waves. The embodiment illustrated in FIG. 3 may provide the same advantages as those mentioned with reference to FIG. 2.

Figure 4:
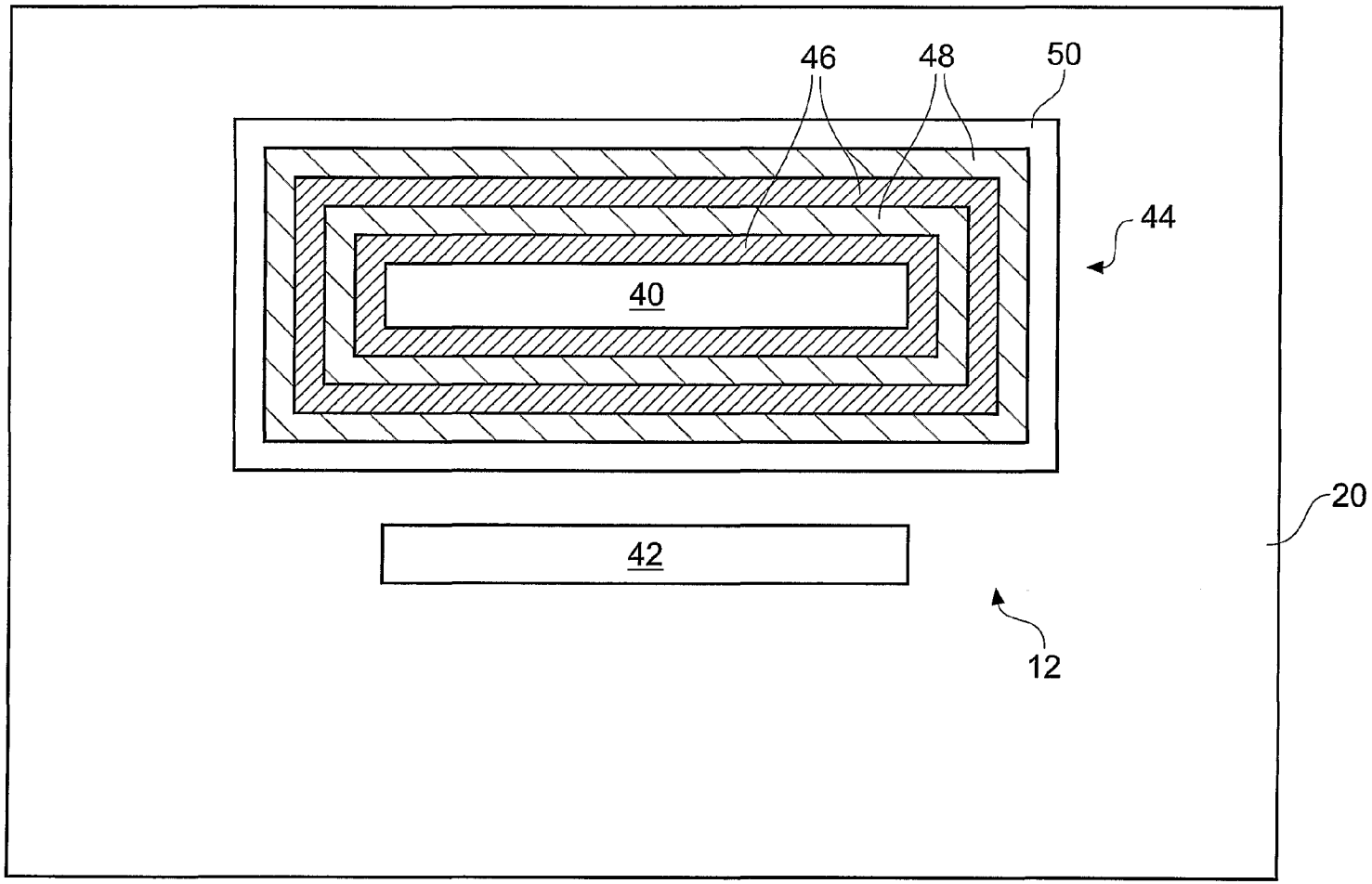
FIG. 4 illustrates a schematic top down view of an antenna arrangement according to a third embodiment of the invention.

FIG. 4 illustrates a schematic top down view of a third embodiment of an antenna arrangement 12. The antenna arrangement 12 includes a first antenna element 40 and a second antenna element 42 mounted on a ground plane 20 via first and second feeds respectively (not illustrated). A laminate attenuator 44 is positioned adjacent the first antenna element 40 and is arranged to attenuate electromagnetic waves transmitted by the second antenna element 42.

In this embodiment, the first antenna element 40 is arranged to transmit and receive electromagnetic waves having a frequency within a first operational frequency band. The second antenna element 42 is arranged to transmit and receive electromagnetic waves having a frequency within a second operational frequency band. The first operational frequency band may be, for example, PCN at 1800 MHz. The second operational frequency band may be, for example, PCS at 1900 MHz.

The laminate attenuator 44 includes a first material 46 and a second material 48 which are arranged alternately to form a plurality of laminas. The plurality of laminas are coupled to each surface of the first antenna element 40 and are oriented so that they are parallel with the surface to which they are coupled. A transducer 50 is coupled to each surface of the plurality of laminas to encapsulate the first antenna element 40 and the plurality of laminas. The operation of the transducer 50 is similar to that of the transducer 28 illustrated in FIG. 2 and will consequently not be discussed in detail here.

The thickness of each lamina of the first material 46 and of the second material 48 is equal to a quarter wavelength of a predetermined frequency within the second operational frequency band. Consequently, the laminate attenuator 44 is arranged to attenuate electromagnetic waves transmitted by the second antenna element 42 and not by the first antenna element 40. The thickness of each lamina is, in this embodiment, approximately 1 micrometer. In operation, the second antenna element 42 transmits electromagnetic waves having a frequency within the second operational frequency band. The transducer 50 converts the electromagnetic waves into acoustic waves having a frequency within the second operational frequency band. The acoustic waves are then at least partially reflected at each interface between the laminas of the first and second materials 46 and 48. The thickness of each lamina results in destructive interference between incident acoustic waves and reflected acoustic waves thereby resulting in attenuation of the acoustic waves.

The laminate attenuator 44 may reduce electromagnetic coupling between the first antenna element 40 and the second antenna element 42 and thereby isolate (electromagnetically) the first antenna element 40 from the second antenna element 42. This may enable the distance between the first antenna element 40 and the second antenna element 42 to be reduced. This antenna arrangement may provide an advantage in that it may require less space in a radio transceiver device 10. Furthermore, it may provide another advantage in that additional electronic circuitry (e.g. an isolator) may not be required in the transceiver 14 which may reduce the cost of the radio transceiver device 10.

Figure 5:
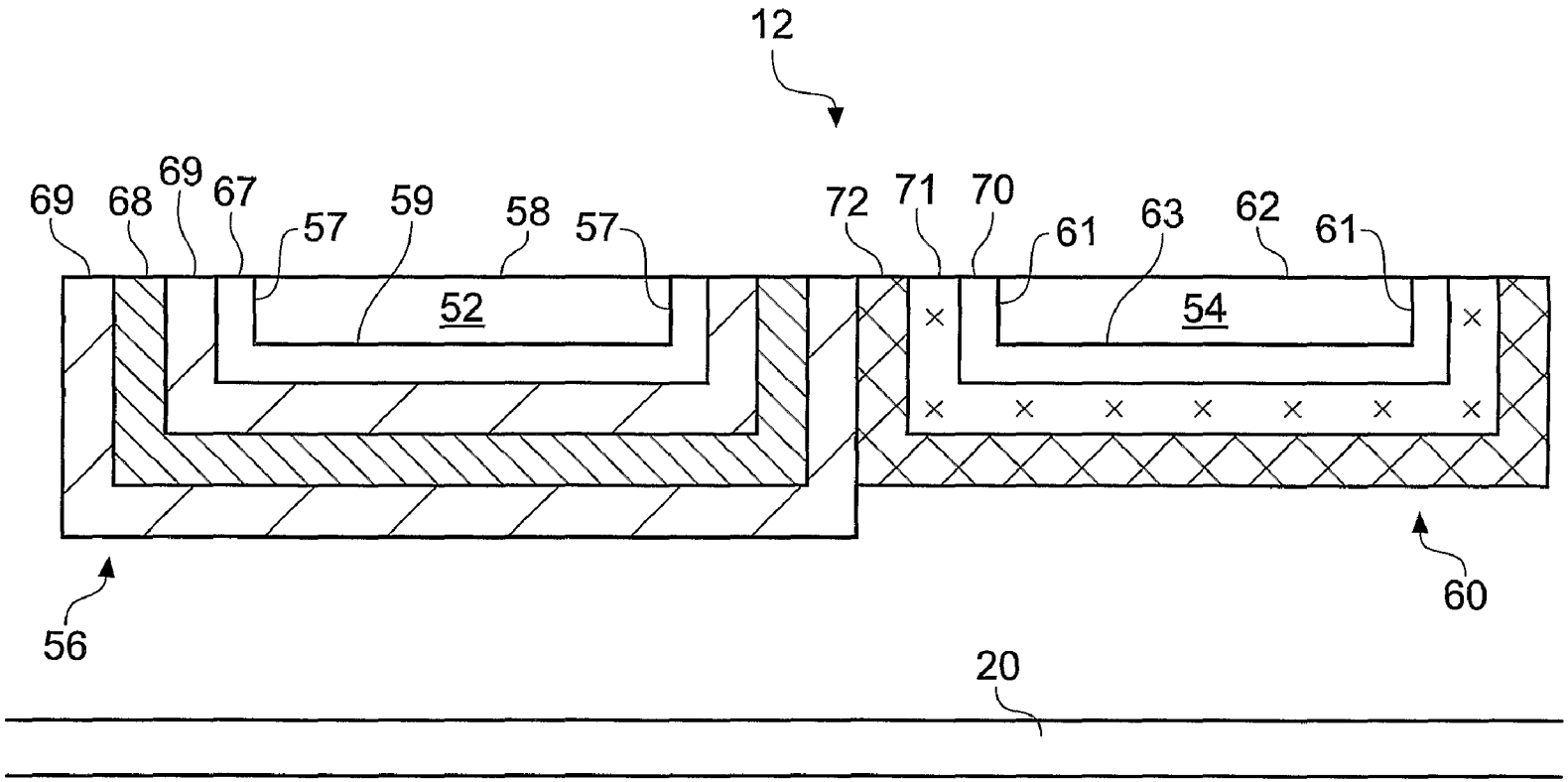
FIG. 5 illustrates a schematic side view of an antenna arrangement according to a fourth embodiment of the invention.

FIG. 5 illustrates a schematic side view of an antenna arrangement 12 according to a fourth embodiment of the invention. The antenna arrangement 12 includes a first antenna element 52 and a second antenna element 54 mounted on a ground plane 20 via first and second feeds (not illustrated for clarity reasons) respectively. The first antenna element 52 is arranged to transmit and receive electromagnetic waves having a frequency within a first operational frequency band and the second antenna element 54 is arranged to transmit and receive electromagnetic waves having a frequency within a second operational frequency band.

The first antenna element 52 and the second antenna element 54 are, in this embodiment, shaped as bars. The first antenna element 52 includes a bottom surface 59, side surfaces 57 and a top surface 58. The second antenna element 54 includes a bottom surface 63, side surfaces 61 and a top surface 62. A first laminate attenuator 56 is positioned adjacent the bottom surface 59 and side surfaces 57 of the first antenna element 52. The first laminate attenuator 56 is not positioned adjacent the top surface 58. A second laminate attenuator 60 is positioned adjacent the bottom surface 63 and side surfaces 61 of the second antenna element 54. The second laminate. attenuator 60 is not positioned adjacent the top surface 62.

The first laminate attenuator 56 is arranged to attenuate electromagnetic waves having a frequency within the first operational frequency band. The second laminate attenuator 60 is arranged to attenuate electromagnetic waves having a frequency within the second operational frequency band. The first and second laminate attenuators 56 and 60 are similar to the laminate attenuator 26 illustrated in FIG. 2.

In more detail, the first laminate attenuator 56 includes a transducer 67 which is physically coupled to the bottom surface 59 and the side surfaces 57 of the first antenna element 52. The first laminate attenuator 56 also includes a first material 69 and a second material 68 which are arranged alternately to form a plurality of laminas. The first material 69 has a substantially different acoustic impedance to the second material 68. The plurality of laminas are oriented substantially parallel to the transducer 67 and are physically coupled to the transducer 67. The transducer 67 and each one of the plurality of laminas are contiguous with one another. The thickness of each lamina of the first laminate attenuator 56 is approximately 1 micrometer. The thickness of the first laminate attenuator 56 is less than 1 millimeter.

The first laminate attenuator 56 is arranged to receive and attenuate electromagnetic waves from the bottom surface 59 and side surfaces 57 of the first antenna element 52. Consequently, only the top surface 58 of the first antenna element 52 is able to substantially transmit/receive electromagnetic waves.

The second laminate attenuator 60 includes a transducer 70 which is physically coupled to the bottom surface 63 and the side surfaces 61 of the second antenna element 54. The second laminate attenuator 60 also includes a first material 71 and a second material 72 which are arranged alternately (not illustrated in the figure for clarity reasons) to form a plurality of laminas. The first material 71 has a substantially different acoustic impedance to the second material 72. The plurality of laminas are oriented substantially parallel to the transducer 70 and are physically coupled to the transducer 70. The transducer 70 and each one of the plurality of laminas are contiguous with one another. The thickness of each lamina of the second laminate attenuator 60 is approximately 1 micrometer. The thickness of the second laminate attenuator 60 is less than 1 millimeter.

The second laminate attenuator 60 is arranged to receive and attenuate electromagnetic waves from the second antenna element 54 from the bottom surface 63 and side surfaces 61 of the second antenna element 64. Consequently, only the top surface 62 of the second antenna element 54 is able to substantially transmit/receive electromagnetic waves.

The antenna arrangement 12 illustrated in FIG. 5 provides similar advantages to those provided by the antenna arrangement illustrated in FIG. 4. For example, the first antenna element 52 is at least partially electromagnetically isolated from the second antenna element 54 and vice versa. Furthermore, in this embodiment the first and second antenna elements 52 and 54 are electromagnetically isolated from the ground plane 20 and may consequently provide the same advantages as those discussed with reference to FIG. 2. For example, the laminate attenuators 56 and 60 may enable a reduction in height of the first and second antenna elements 52 and 56 above the ground plane 20.

Figure 6:
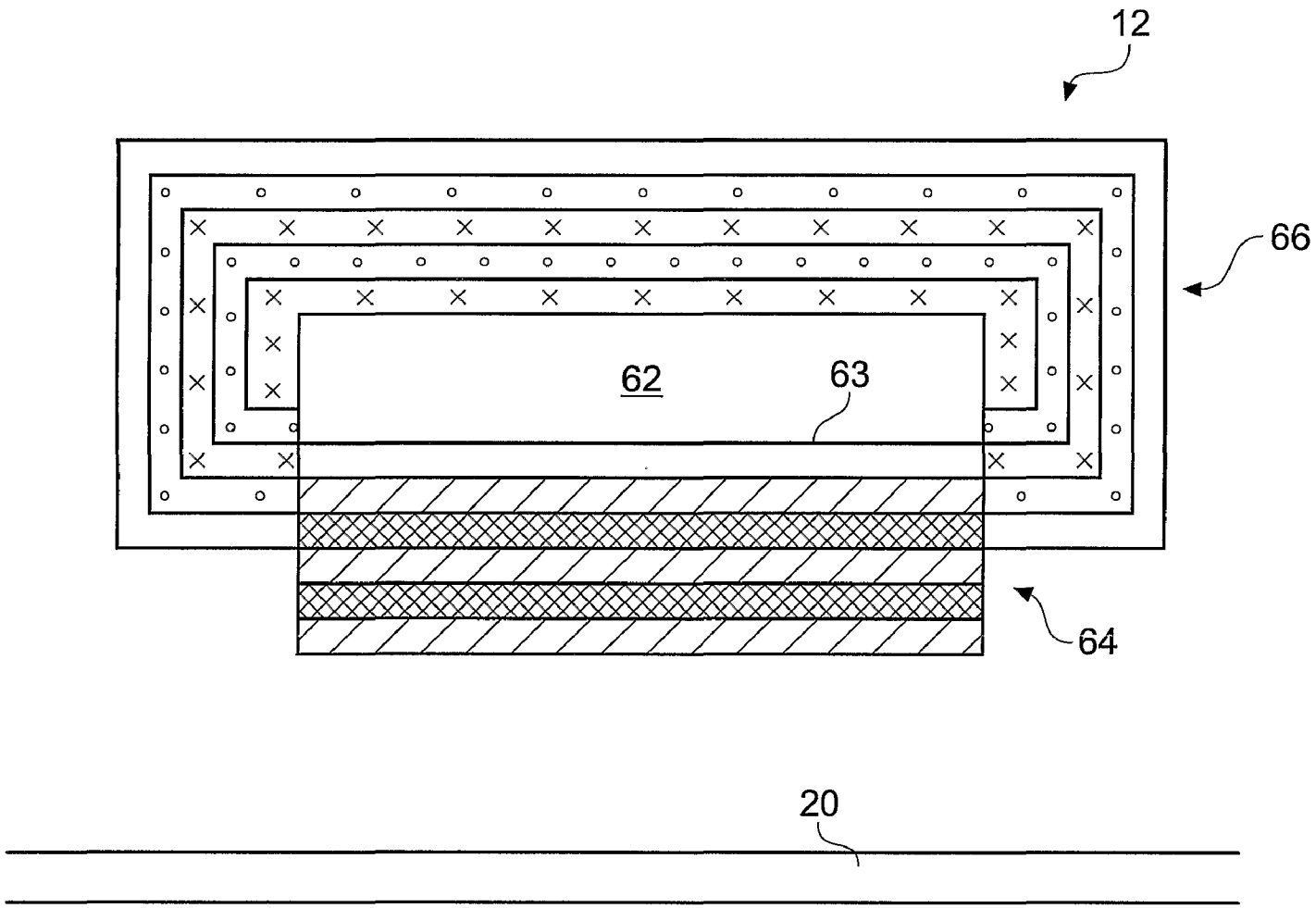
FIG. 6 illustrates a schematic side view of an antenna arrangement according to a fifth embodiment of the invention.

FIG. 6 illustrates a schematic side view of an antenna arrangement 12 according to a fifth embodiment of the invention. The antenna arrangement 12 includes an antenna element 62 that is arranged to transmit and receive electromagnetic waves having a frequency within a first operational frequency band. The antenna element 62 is mounted on a ground plane 20 via a feed (not illustrated for clarity reasons). A first laminate attenuator 64 is positioned adjacent a bottom surface 63 of the antenna element 62. A second laminate attenuator 66 is positioned adjacent the remaining surfaces of the antenna element 62.

The first laminate attenuator 64 is substantially similar to the laminate attenuator 26 illustrated in FIG. 2 and will consequently not be discussed in detail here. Alternatively, the first laminate attenuator 64 may be substantially similar to the laminate attenuator 34 illustrated in FIG. 3. The first laminate attenuator is arranged to electromagnetically isolate the antenna element 62 from the ground plane 20. As mentioned with reference to FIG. 2, the first laminate attenuator 64 provides an advantage in that it may improve the bandwidth of the antenna element 62 at a given height above the ground plane 20 and may help to reduce the profile of the antenna arrangement 12.

The second laminate attenuator 66 is substantially similar to the laminate attenuator 44 illustrated in FIG. 4 and its operation will consequently not be discussed in detail here. The second laminate attenuator 66 is arranged to electromagnetically isolate the antenna element 62 from an antenna element within the radio transceiver device 10, i.e. the second laminate attenuator 66 is arranged to attenuate electromagnetic waves having a particular frequency range outside of the first operational frequency band. The laminate attenuator 66 may provide an advantage in that it may allow a reduction in separation between the antenna element 62 and any other antenna elements within the radio transceiver device 10.

Although embodiments of the present invention have been described in the preceding paragraphs with reference to various examples, it should be appreciated that modifications to the examples given can be made without departing from the scope of the invention as claimed. For example, the device 10 may include a transmitter or a receiver instead of the radio transceiver circuitry 14.

Whilst endeavoring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

I claim:

1. An antenna arrangement comprising:

a ground plane;

a first antenna element having one or more surfaces and configured to operate in at least a first operational frequency; and a laminate attenuator, positioned between the first antenna element and the ground plane and adjacent a portion of at least one surface of the first antenna element, wherein the laminate attenuator is configured to attenuate predetermined radio frequency electromagnetic waves, and wherein the laminate attenuator comprises a transducer configured to convert electromagnetic waves having a frequency within the first operational frequency band into an acoustic wave having a frequency within the first operational frequency band.

2. An antenna arrangement as claimed in claim 1, wherein the laminate attenuator comprises a plurality of laminas, wherein at least one of the laminas comprises metal.

3. An antenna arrangement as claimed in claim 1, wherein the laminate attenuator comprises a plurality of laminas and wherein the transducer is positioned between the first antenna element and the plurality of laminas.

4. An antenna arrangement as claimed in claim 3, wherein the laminate attenuator comprises a first material and a second material which are arranged alternately to form the plurality of laminas, the first material and the second material having substantially different acoustic impedances.

5. An antenna arrangement as claimed in claim 3, wherein each lamina of the plurality of laminas has a thickness which is equal to one quarter of the wavelength of the acoustic wave.

6. An antenna arrangement as claimed in claim 3, wherein at least one of the plurality of laminas comprises metal.

7. An antenna arrangement as claimed in claim 1, wherein the transducer comprises piezoelectric material.

8. An antenna arrangement as claimed in claim 1, further comprising a second antenna element configured to operate in at least a second operational frequency band, wherein the laminate attenuator is configured to attenuate an electromagnetic wave having a frequency within the second operational frequency band.

9. An antenna arrangement as claimed in claim 8, wherein the laminate attenuator comprises a transducer which is configured to convert electromagnetic waves having a frequency within the second operational frequency band into an acoustic wave having a frequency within the second operational frequency band.

10. An antenna arrangement as claimed in claim 9, wherein the laminate attenuator comprises a plurality of laminas which are positioned adjacent the first antenna element and wherein the transducer is positioned adjacent the plurality of laminas, remote from the first antenna element.

11. An antenna arrangement as claimed in claim 10, wherein the laminate attenuator comprises a first material and a second material which are arranged alternately to form the plurality of laminas, the first material and the second material having substantially different acoustic impedances.

12. An antenna arrangement as claimed in claim 10, wherein each lamina of the plurality of laminas has a thickness which is equal to one quarter of the wavelength of the acoustic wave.

13. An antennas arrangement as claimed in claim 9, wherein the transducer comprises piezoelectric material.

14. An antenna arrangement as claimed in claim 8, wherein the laminate attenuator is positioned adjacent each surface of the first antenna element.

15. An antenna arrangement as claimed in claim 8, wherein the first antenna element is configured to operate in at least a first operational frequency band, and the antenna arrangement comprises a further laminate attenuator, positioned adjacent a portion of at least one surface of the first antenna element, wherein the further laminate attenuator is configured to attenuate electromagnetic waves having a frequency within the first operational frequency band.

16. An antenna arrangement as claimed in claim 15, further comprising a ground plane, wherein the further laminate attenuator is positioned between the first antenna element and the ground plane.

17. An electronic device comprising an antenna arrangement as claimed in claim 1.

18. A method comprising:

providing a first antenna element having one or more surfaces and being configured to operate in at least a first operational frequency band;

positioning a laminate attenuator between the first antenna element and a ground plane and adjacent a portion of at least one surface of the first antenna element, wherein the laminate attenuator is configured to attenuate predetermined radio frequency electromagnetic waves;

and wherein the laminate attenuator comprises a transducer configured to convert electromagnetic waves having a frequency within the first operational frequency band into an acoustic wave having a frequency within the first operational frequency band.

19. A method as in claim 18, wherein the transducer comprises piezoelectric material.

20. A method as claimed in claim 18, further comprising providing a second antenna element configured to operate in at least a second operational frequency band, wherein the laminate attenuator is configured to attenuate an electromagnetic wave having a frequency within the second operational frequency band.

* * * * *